US008505143B2

(12) United States Patent
Finezilber

(10) Patent No.: US 8,505,143 B2
(45) Date of Patent: Aug. 13, 2013

(54) PROGRAMMABLE STEERABLE ROBOT PARTICULARLY USEFUL FOR CLEANING SWIMMING POOLS

(76) Inventor: Gedaliahu Finezilber, East Brunswick, NJ (US)

( * ) Notice: Subject to any disclaimer, the term of this patent is extended or adjusted under 35 U.S.C. 154(b) by 384 days.

(21) Appl. No.: 13/005,416

(22) Filed: Jan. 12, 2011

(65) Prior Publication Data

US 2012/0174326 A1 Jul. 12, 2012

Related U.S. Application Data

(63) Continuation of application No. 11/604,831, filed on Nov. 28, 2006, now abandoned.

(51) Int. Cl.
*E04H 4/16* (2006.01)

(52) U.S. Cl.
USPC ..... 15/1.7; 701/51

(58) Field of Classification Search
USPC ..... 15/1.7; 901/1; 180/6.66, 204; 701/51
See application file for complete search history.

(56) References Cited

U.S. PATENT DOCUMENTS

| | | | |
|---|---|---|---|
| 3,229,315 | A | 1/1966 | Watson |
| 3,551,930 | A | 1/1971 | Myers |
| 3,689,408 | A | 9/1972 | Edmiston et al. |
| 3,790,979 | A | 2/1974 | Foster |
| 3,972,339 | A | 8/1976 | Henkin et al. |
| 4,449,265 | A | 5/1984 | Hoy |
| 4,521,933 | A | 6/1985 | Raubenheimer |
| 4,560,418 | A | 12/1985 | Raubenheimer |
| 5,001,800 | A | 3/1991 | Parenti et al. |
| 5,197,158 | A | 3/1993 | Moini |
| 5,435,031 | A | 7/1995 | Minami et al. |
| 5,507,058 | A | 4/1996 | Minami et al. |
| 5,569,371 | A | 10/1996 | Perling |
| 5,617,600 | A | 4/1997 | Prattini |
| 6,131,227 | A | 10/2000 | Rief et al. |
| 6,292,970 | B1 | 9/2001 | Rief et al. |
| 6,782,578 | B1 | 8/2004 | Rief et al. |
| 6,854,148 | B1 | 2/2005 | Rief et al. |
| 8,117,704 | B2 * | 2/2012 | Schneider et al. ..... 15/1.7 |

* cited by examiner

*Primary Examiner* — Laura C Guidotti
(74) *Attorney, Agent, or Firm* — Lawrence C. Edelman, Esq

(57) ABSTRACT

A programmable steerable robot, particularly useful for cleaning swimming pools, includes: a body member; a first ground-engaging rotary propelling device at one side of the body member; a second ground-engaging rotary propelling device at an opposite side of the body member; a rotary brush carried by the body member engageable with walls of the swimming pool for cleaning same; a drive for driving both of the rotary propelling devices and the rotary brush; a transmission system connecting the drive to both of the rotary propelling devices and the rotary brush; and a programming device controlling the transmission system such that, for preselected travel intervals, both rotary propelling devices are driven in the same direction to propel the body member along a linear path, and for other preselected time intervals, the rotary propelling devices are controlled such that the body member is propelled along a different path.

20 Claims, 4 Drawing Sheets

PROGRAMMABLE STEERABLE ROBOT PARTICULARLY USEFUL FOR CLEANING SWIMMING POOLS

CROSS-REFERENCE TO RELATED APPLICATION

This application is a continuation of and claims the benefit of priority under 35 USC 120 of U.S. patent application Ser. No. 11/604,831 filed Nov. 28, 2006, now abandoned entitled "Programmable Steerable Robot Particularly Useful For Cleaning Swimming Pools". The entire disclosure of this prior patent application is incorporated herein by reference in its entirety.

FIELD AND BACKGROUND OF THE INVENTION

The present invention relates to a programmable steerable robot. The invention is particularly useful as a robot for cleaning swimming pools, and is therefore described below with respect to this application, but it will be appreciated that the invention could be used in many other applications, such as in toy robots, carpet cleaner robots, robotic lawn mower, and the like.

Programmable steerable robots are known in the prior art for cleaning swimming pools. Such known robots are self-propelled, either by self-contained electrical motor drives, or by hydraulic motor drives which are coupled to the swimming pool suction system for propelling the robot. An example of an electrically-driven robot of this type is described in U.S. Pat. No. 5,617,600; and an example of a hydraulically-driven robot of this type is described in U.S. Pat. No. 5,001,800. Both types of robots are designed to function under water, and to be self-propelled so as to clean the bottom and side surfaces of the swimming pools. Both types are therefore generally programmable so as to automatically change the direction of travel according to the dimensions of the surfaces being cleaned.

One advantage of the electrically-driven robots of this type is that they are much more easily programmable to automatically control the electrical motors according to the paths to be traversed by the robot. A disadvantage of electrically-driven robots, however, is that the electrical motor drives, as well as all the other electrical components, must be completely sealed against the entry of water. Hydraulically-driven robots of this type do not require complete sealing since they have no electrical components; however, they are difficult to program to automatically control the path of travel of the robot according to the surfaces being cleaned. For example, the swimming-pool robot described in the above-cited U.S. Pat. No. 5,001,800, includes cam members driven by the hydraulic motor to selectively raise the propelling devices according to the desired path of travel of the robot. Among other disadvantages, such a programming device is, as a practical matter, limited as to the various programs that can be preset.

OBJECTS AND BRIEF SUMMARY OF THE PRESENT INVENTION

An object of the present invention is to provide a programmable steerable robot which permits a wide range of programs to be preset. Another object of the present invention is to provide a programmable steerable robot particularly useful for cleaning swimming pools and having advantages in the above respects.

According to a broad aspect of the present invention, there is provided a programmable steerable robot, comprising: a body member; a first ground-engaging rotary propelling device at one side of the body member; a second ground-engaging rotary propelling device at an opposite side of the body member; a drive for driving both of the rotary propelling devices, a transmission system connecting the drive to both of the rotary propelling devices; and a programming device controlling the transmission system such that, for preselected travel intervals, both rotary propelling devices are driven in the same direction to propel the body member along a linear path, and for other preselected time intervals, the rotary propelling devices are controlled such that the body member is propelled along a different path.

In the described preferred embodiment, during the latter preselected time intervals, one rotary propelling device is driven in one direction, and the other rotary propelling device is driven in the opposite direction such that the body member is propelled along a sharply-curved path. It will be appreciated, however, that the other rotary propelling device may be controlled so as not to be driven but rather to be decoupled from the drive, whereupon the body member would be propelled along a more gradually-curved path.

According to further features in the described preferred embodiment, one side of the body member includes a pair of the first rotary propelling devices on opposite ends of the respective side connected to the drive by a first section of the transmission system, and the opposite side of the body member includes a pair of the second rotary propelling devices at opposite ends of the respective side connected to the drive by a second section of the transmission system. The programming device controls the second section of the transmission system.

According to further features in the described preferred embodiment, the programming device includes a rotary programming member also driven by the drive, and a plurality of presettable elements individually presettable for controlling the transmission system for a predetermined travel interval of the rotary propelling devices. The presettable elements control a section of the transmission system connecting the second rotary propelling device to the drive.

In the described preferred embodiment, the section of the transmission system controlled by the presettable elements includes a reversing mechanism selectively actuatable by the presettable elements. The reversing mechanism is normally spring-biased to drive the second rotary propelling device in the same direction as the first rotary propelling device, but is actuatable by the presettable elements to actuate the reversing mechanism to drive the second rotary propelling device in the opposite direction as the first rotary propelling device.

According to still further features in the described preferred embodiment, the presettable elements are pins each individually presettable on the rotary programming member to either a normal position or to an extended position.

In the described preferred embodiment, the programmable steerable robot is a swimming pool cleaner. In this case, the body member may also include, if desired, a rotary brush driven by the drive and engageable with the walls of the swimming pool for cleaning same. Also, in the described preferred embodiment, the drive may include a hydraulic motor connectable to a suction system suctioning out water from the swimming pool for filtering and/or disinfecting purposes.

It will be appreciated, however, that the invention could also be used in other types of robots, for example toy robots, carpet-cleaning robots, and grass-cutting robots, and that the drive could be an electrical drive, rather than a hydraulic drive.

Further features and advantages of the invention will be apparent from the description below.

BRIEF DESCRIPTION OF THE DRAWINGS

The invention is herein described, by way of example only, with reference to the accompanying drawings, wherein.

Figure 1:
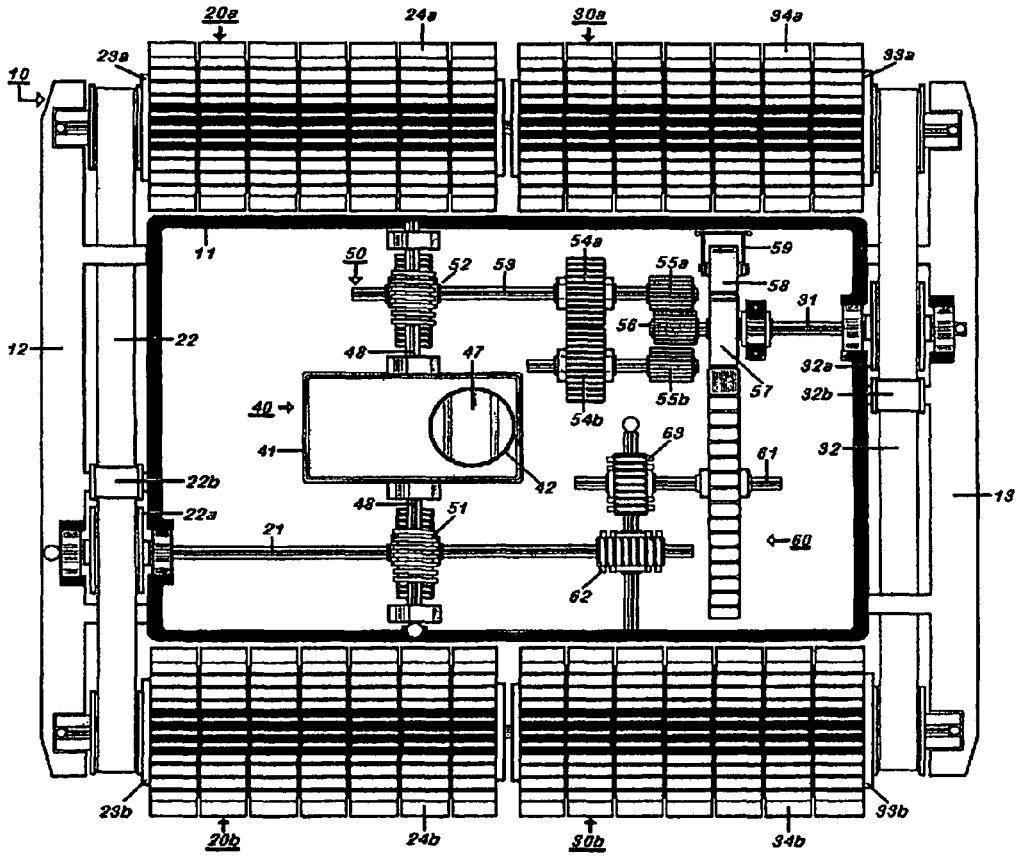
FIG. 1 is a diagrammatic top view illustrating one form of programmable steerable robot constructed in accordance with the present invention.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiment described is for purposes of example only, and that the invention is capable of being embodied in other forms and applications than described herein.

DESCRIPTION OF A PREFERRED EMBODIMENT

Overall Construction

As indicated earlier, the preferred embodiment of the invention illustrated in the drawings is a programmable steerable robot particularly useful for cleaning swimming pools. It includes a body member, generally designated 10; a pair of first ground-engaging rotary propelling devices 20*a*, 20*b* carried on opposite ends of one side of body member 10; and a second pair of ground-engaging rotary propelling devices 30*a*, 30*b* carried by the body member at opposite ends of the other side of the body member. The illustrated robot further includes a common drive, generally designated 40 for driving both pairs of rotary propelling devices; and a transmission system, generally designated 50, connecting the common drive to both pairs of rotary propelling devices.

A programming device, generally designated 60, controls transmission system 50, as will be described more particularly below, such that for preselected travel intervals both pairs of rotary propelling devices are driven in the same direction to propel the body member 10 along a linear path, and for other preselected travel intervals one pair of rotary propelling devices is driven in one direction, whereas the other pair is controlled such that the body member is propelled along a curved path. As will described below, this control applied at the latter travel intervals causes one pair of rotary propelling devices 20*a*, 20*b*, to be driven in one direction, and the other pair of rotary propelling devices 30*a*, 30*b*, to be driven in the opposite direction, such that the body member, during the latter intervals, is propelled along a sharply curved path, i.e., is rotated about its central axis.

Since the illustrated robot is used for cleaning swimming pools, it further includes a plurality of rotary brushes 70 (FIG. 2) driven by the common drive 40 and engageable with the bottom and side surfaces of the swimming pool for cleaning them as the robot is propelled therealong.

Body member 10 includes a rectangular frame or chassis 11 mounting within it the drive 40 and the major part of the transmission system 50. The two pairs of rotary propelling devices 20*a*, 20*b* and 30*a*, 30*b* are rotatably mounted outwardly of opposite ends of frame 11. The first pair of rotary propelling devices 20*a*, 20*b* are coupled to drive 40 by a shaft 21 and a pulley belt 22 driven by a toothed pulley wheel 22*a;* whereas the second pair of rotary propelling devices 30*a*, 30*b* are coupled to the drive via a shaft 31 and pulley belt 32 driven by a toothed pulley wheel 32*a*. Each pulley belt 22, 32 includes a tensioning device 22*b* and 32*b*, respectively. Body member 10 further includes a side plate 12 covering pulley belt 22, and a second side plate 13 covering pulley belt 32.

Figure 2:
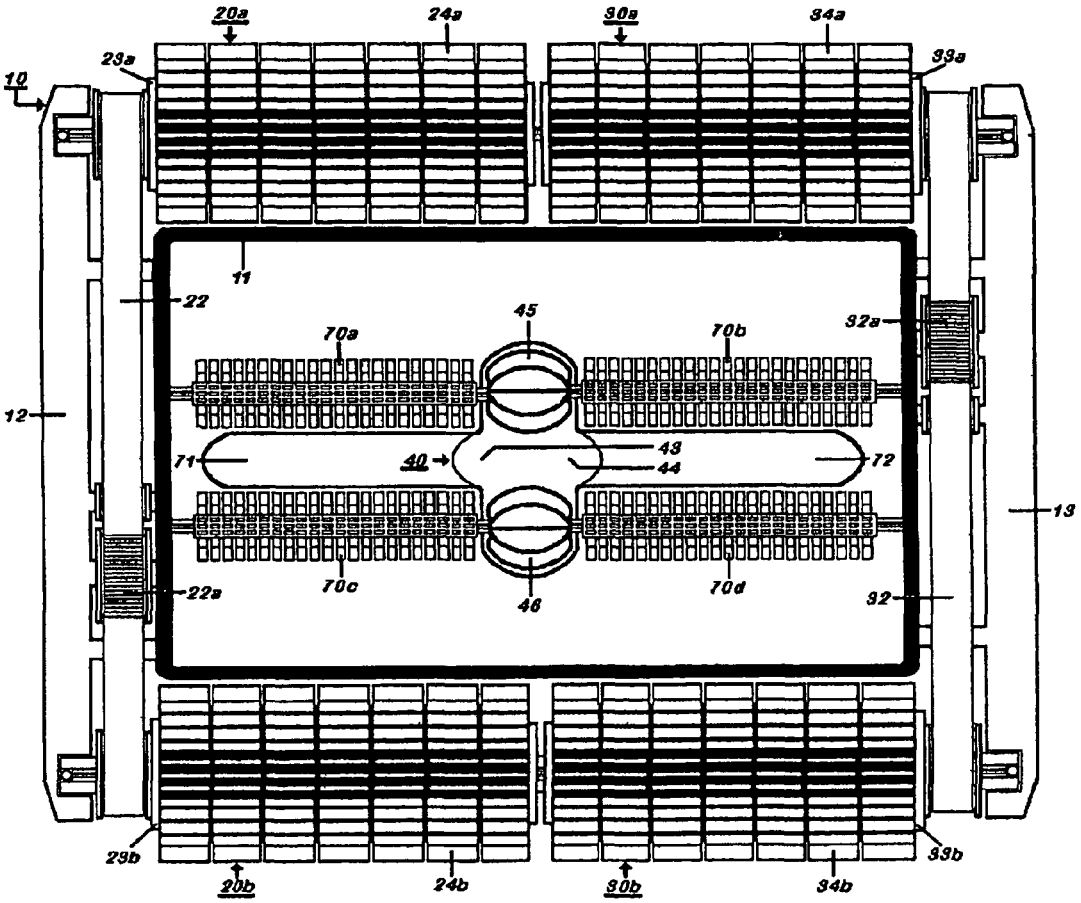
FIG. 2 is a diagrammatic bottom view of the programmable steerable robot of FIG. 1.

Each of the rotary propelling devices 20*a*, 20*b* and 30*a*, 30*b*, includes a drum 23*a*, 23*b* and 33*a*, 33*b*, driven by its respective pulley belt 22, 32. As shown in FIGS. 1 and 2, each drum carries a plurality of externally-ribbed rubber belts or sheets 24*a*, 24*b* and 34*a*, 34*b*, respectively, in a close side-by-side relation. As will be described below, the buoyancy of the robot can be fixed such that the rotary propelling devices will firmly engage the surface along which the robot is propelled so as to produce no slippage therebetween, or only lightly engage such surfaces so as to produce some slippage therebetween and thus enhance the cleaning action of the robot.

Drive 40, which drives all the rotary propelling devices 20*a*, 20*b* and 30*a*, 30*b*, as well as the rotary brushes 70, is a hydraulic motor. It includes a housing 41 having a coupling 42 connectable to a flexible hose (not shown) of the suction pump in the system of the swimming pool used for suctioning out water from the swimming pool in order to filter and/or disinfect the water. When coupling 42 is connected to the swimming pool suctioning system, the water is inletted into housing 41 via two openings 43, 44 at the bottom of housing 41, as shown in FIG. 2 and outletted via coupling 42.

Drive housing 41 further includes a pair of turbines or water wheels 45, 46 (FIG. 2) aligned with the two inlet openings 43, 44 in the bottom of the housing for directly driving the rotary brushes 70*a*, 70*b*, 70*c*, 70*d*. Thus, as shown in FIG. 2, turbine 45 directly drives the two brushes 70*a*, 70*b* at its opposite sides, and turbine 46 directly drives the brushes 70*c*, 70*d* on its opposite sides.

The bottom of the robot further includes a channel member 71, 72 between each pair of brushes 70*a*, 70*b*, and 70*c*, 70*d* for directing the water into the inlet openings 43, 44 of drive housing 41. The brushes are rotated in the direction to direct the scrapings from the swimming pool surface being cleaned into channel members 71, 72 to thereby enhance their cleaning action.

The swimming pool may have surfaces of a conventional construction, such as ceramic tiles, vinyl, fiberglass or concrete.

Drive housing 41 includes a further turbine 47 (FIG. 1) having an output rotary shaft 48 which is coupled, via the transmission system 50, to drive both pairs of rotary propelling devices 20*a* and 20*b* and 30*a*, 30*b*, as well as the programming device 60.

Thus, one side of output shaft 48 is coupled via speed-reduction gearing 51 to shaft 21, which drives pulley belt 22 coupled at its opposite ends to rotary propelling devices 20*a* and 20*b*, respectively. The opposite end of output shaft 48 is coupled via speed-reduction gearing 52 to shaft 31 which drives pulley belt 32 coupled at its opposite ends to rotary propelling devices 30*a*, 30*b*, respectively. The latter coupling, however, includes a controlled section of the transmission having a reversing mechanism which is selectively controlled by programming device 60.

Thus, speed reduction gearing 52 is driven by the drive output shaft 48 and in turn drives an intermediate shaft 53. Shaft 53 drives a gear 54*a* in one direction, and another gear 54*b*, meshing with gear 54*a*, in the opposite direction. Gear 54*a* is directly connected to another gear 55*a*, and gear 54*b* is directly connected to another gear 55*b*, so that gears 55*a* and 55*b* also rotate in the opposite directions as their respective gears 54*a*, 54*b*.

Shaft 31, driving pulley belt 32, carries another gear 56 which is selectively coupled to either gear 55*a* to rotate belt 32 in one direction, or gear 55*b* to rotate belt 32 in the opposite direction. The position of gear 56 is selectively controlled so as to be in engagement with gear 55*a* or gear 55*b*. This selective control is by the programming device 60, via a cam follower 57. Cam follower 57 is normally biassed to the position illustrated in FIG. 1, wherein gear 56 meshes with gear 55*a* to drive pulley belt 32 in one direction. This normal bias of cam follower 57 is effected by a pivotally mounted pressure wheel 58 urged to the position illustrated in FIG. 1 by a tension spring 59. However, as will described below, programming device 60 may be presettable to actuate cam follower 57, such as to move its gear 56 out of engagement with gear 55*a* and into engagement with gear 55*b* at any preselected travel intervals as preset in programming device 60.

As will also be described below, the transmission is such that when gear 56 engages gear 55*b*, pulley belt 32 is driven in the direction to rotate the rotary propelling devices 30*a*, 30*b* in the forward direction, i.e., the same direction as rotary propelling devices 20*a*, 20*b;* whereas when gear 56 is moved into engagement with gear 55*a*, pulley belt 32 is driven in the opposite direction, to rotate the rotary propelling devices 30*a*, 30*b* in the reverse direction with respect to rotary propelling devices 20*a*, 20*b*.

Programming Device 60

Programming device 60 is also a rotary device or wheel rotatably mounted on shaft 61. Shaft 61 is directly driven by hydraulic motor 40 via its output shaft 48, drive shaft 21, speed-reduction gearing 62 and speed-reduction gearing 63. It will thus be seen that programming device 60 is driven at a rotational speed directly related to the travel speed of the robot produced by the rotation of the rotor propelling devices 20*a*, 2*b* and 30*a*, 30*b*, respectively.

The structure of programming device 60, and the manner in which it controls the position of gear 56 to drive pulley belt 32 in either one direction or the opposite direction, are more clearly seen in FIGS. 3-6.

Thus, as briefly described earlier, programming device 60 is in the form of a rotary wheel carried by shaft 61 rotated by hydraulic motor 40 via its output shaft 48, shaft 21, and speed-reduction gearing 51, 62 and 63. Rotary programming wheel 60 includes a plurality of presettable elements 64. Each element 64 is individually presettable to a normal inner position as indicated by presettable element 64*a*, or to an extended outer position as indicated by presettable elements 64*b*. Presettable elements 64 may be, for example, pins or tabs individually presettable to the two positions indicated by element 64*a* and 64*b*. Cam follower 57 is spring-urged by roller 58 and spring 59 into engagement with the outer surface of programming wheel 60 so that it will follow the outer surface of the programming wheel.

Figure 3:
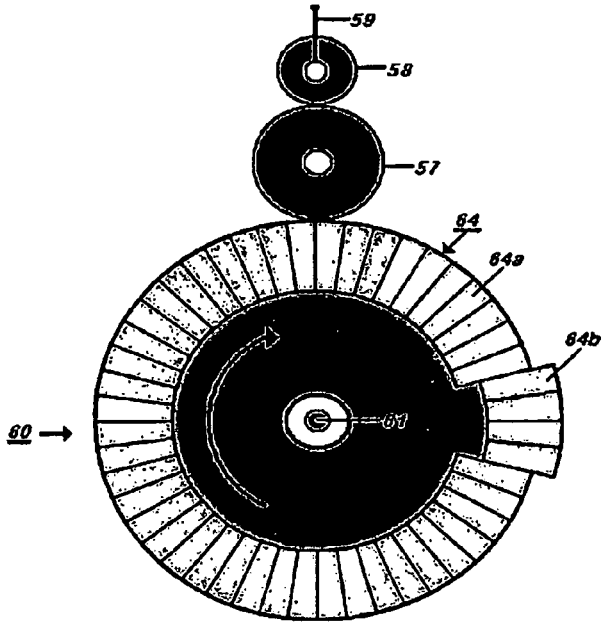
FIGS. 3 and 4 are diagrammatic side and end views, respectively, illustrating the manner in which the programming device in the robot of FIGS. 1 and 2 controls the transmission system of one of the rotary propelling devices for producing a linear path of travel of the robot.
Figure 4:
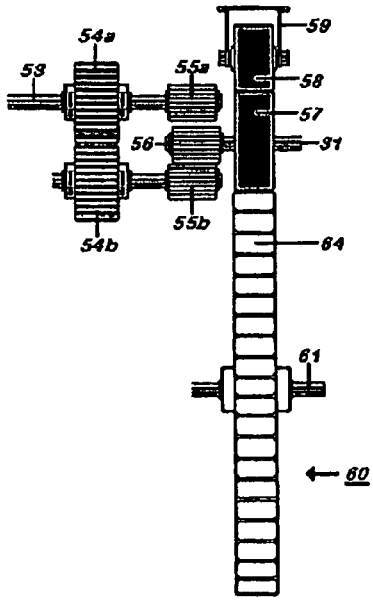
Figure 5:
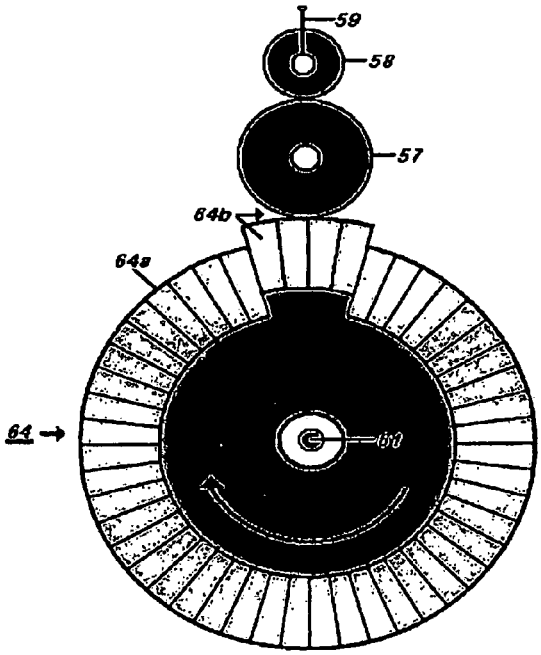
FIGS. 5 and 6 are corresponding diagrammatic views illustrating the programming device when producing a curved path of travel of the robot.
Figure 6:
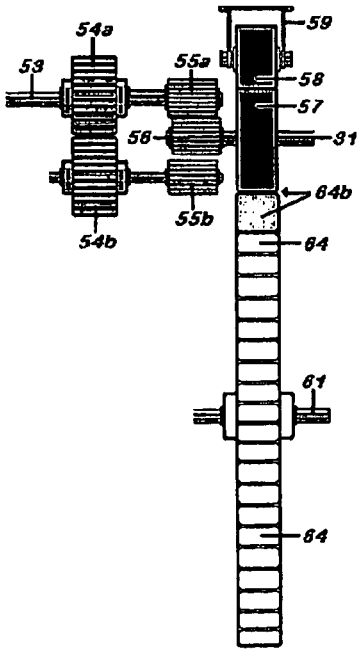

Thus, as shown in FIGS. 3 and 4, when cam follower 57 engages elements 64 of programming wheel 60 in the normal inner positions of the presettable elements, as indicated by elements 64*a* in FIG. 3, cam follower 57 is urged by pressure roller 58 and spring 59 to an inner position wherein gear 56 carried by the cam follower is moved into meshing engagement with the forward-direction gear 55*b* so that pulley belt 32 is driven to rotate the rotary propelling devices 30*a*, 3*b* in the forward direction. When cam follower 57 engages an outwardly-preset element 64*b*, as shown in FIGS. 5 and 6, cam follower 57 is moved, against its biasing spring 59, to the position illustrated in FIGS. 5 and 6, wherein its gear 56 meshes with reverse-direction gear 55*a*, to thereby drive pulley belt 32 to rotate the rotary propelling devices 30*a,* 30*b* in the reverse direction.

Operation

The operation of the programmable steerable robot illustrated in the drawings for cleaning swimming pool surfaces will be apparent from the above description.

Programming device 60 is first pre-programmed by individually presetting its presettable elements 64 to automatically control the robot according to the path of movement desired for the respective swimming pool. Thus, each presettable element 64 is preset to its normal inner position, as indicated by elements 64*a* in FIGS. 3 and 5, when the robot is to travel along a linear path, and is preset to its outer position, as indicated by elements 64*b*, when the robot is to travel along a curved path, e.g., to make a 45 degree turn in its path for each element so preset. Thus, where four successive elements are preset to their outer positions, as indicated in FIGS. 3 and 5, this will cause the robot to turn 180 degrees, and thereby reverse its direction of travel.

After the programming device has been preset according to the path of travel to be automatically effected by the robot, the robot is placed on the bottom surface of the swimming pool to be cleaned, and its coupling 42 is connected to the pump of the suction system normally provided in swimming pools for suctioning out water from the swimming pool for purposes of filtering the water and/or adding disinfectant. The water thus enters housing 41 of the hydraulic motor 40 to rotate the two turbines 45, 46 (FIG. 2) and also turbine 47 (FIG. 1) within the motor housing. Rotation of turbines 45, 46 rotates the brushes 70 (FIG. 2), producing a brushing action with respect to the contacted surface of the swimming pool, whereas rotation of turbine 47 propels the robot along the surface according to the program preset by the programming device 60.

In the described example, the rotary propelling devices 20*a*, 20*b* on opposite ends of one side of the robot will always be propelled in the same direction, i.e., the forward direction, because of the direct coupling of the output shaft 48 of hydraulic motor 40 with those rotary propelling devices via speed-reduction gearing 51, shaft 21, and pulley belt 22. On the other hand, the other pair of rotary propelling devices 30*a*, 30*b*, at the opposite ends of the opposite side of the robot, will be controlled by the presettable elements 64 of the programming device 60, to control the position of gear 56 coupled, via shaft 31 and pulley belt 32, to these rotary propelling devices.

Thus, as shown in FIGS. 3 and 4, cam follower 57 is normally spring-urged, by pressure wheel 58 and spring 59, into engagement with the outer surface of programming wheel 60. Accordingly, when cam follower 57 engages a presettable element 64 in its inner, normal position, as indicated at 64*a*, cam follower 57 is spring-urged to mesh gear 56 with the forward-direction gear 55*b*. As indicated above, this drives shaft 31 in the forward direction, to rotate the rotary propelling devices 30*a*, 30*b* in the forward direction, i.e., in the same direction as rotary propelling devices 20*a*, 20*b*. This normal condition is the one illustrated in FIGS. 3 and 4. FIGS. 5 and 6 illustrate the condition wherein cam follower 57 engages programming elements 64 which have been preset to their outer positions, indicated at 64*b*. When this occurs, cam follower 57 is moved (upwardly, FIGS. 4 and 5) against the action of spring 59, to bring gear 56 into meshing engagement with reverse-direction gear 55*a*, to rotate shaft 31, and thereby the rotary propelling devices 30*a* ,30*b*, in the opposite direction with respect to rotary propelling devices 20*a*, 20*b*, i.e., in the reverse direction.

It will thus be seen that when cam follower 57 engages the presettable elements 64 in their inner positions, as indicated by elements 64*a* in FIGS. 3-6, both pairs or rotary propelling devices 20*a*, 20*b* and 30*a*, 30*b* will be rotated in the same direction, and will thereby propel the robot in a linear path. On the other hand, when cam follower 57 engages a presettable element in its outer position, as indicated at 64*b* in FIGS. 3-6, the rotary propelling devices 30*a*, 30*b* will be rotated in the opposite direction from rotary propelling devices 20*a*, 20*b*, whereby the robot will be propelled along a curved path. In the described preferred embodiment, this curved path will be a 45 degree turn for each element 64 in its outer position 64*b;* thus, if it is desired to reverse the travel direction of the robot, four successive elements would be preset in their outer positions, as indicated in FIGS. 5 and 6.

It will thus be seen that when hydraulic motor 40 of the robot is connected to the swimming pool suction system, the robot will be automatically propelled along the surface to be cleaned according to the program preset by programming device 60. During its travel along the surface, the brushes 70 (FIG. 2) are continuously rotated so as to clean the surface. As indicated earlier, the buoyancy of the robot can be controlled, e.g., by initial design or by adding float elements, so as to produce a desired degree of slippage between the surfaces and the ribbed rubber belts or sheets 24*a*, 24*b* and 34*a*, 34*b*, respectively, of the rotary propelling devices, to thereby enhance the scraping or scrubbing action of the robot.

Some Variations and Other Applications

While the invention has been described with respect to a particular construction of a hydraulically-driven programmable steerable robot for cleaning swimming pools, it will be appreciated that this is set forth merely for purposes of example, and that many variations, modifications and other applications may be made. For example, the invention could be implemented in a robot which is electrically driven, rather than hydraulically driven. In addition, the invention could be implemented in other types of robots, for example toy robots, carpet vacuuming robots, etc Further, the robot could be controlled to traverse a curved path during preselected time intervals, by merely decoupling the rotary propelling devices at one side of the robot, rather than reversing the direction of rotation thereof, in which case the curved path would be a more gradually curved path. If desired, the robot could include a controlled section of the transmission for each pair of rotary propelling devices, each pair being controlled by a programming device such that one pair is reversed to make a right turn, and the other pair is reversed to make a left turn.

Many other variations, modifications and applications of the invention will be apparent to those skilled in the art.

What is claimed is:

1. A programmable steerable robot for cleaning swimming pools and the like, comprising:

a body member;

a first ground-engaging rotary propelling device at one side of the body member;

a second ground-engaging rotary propelling device at an opposite side of the body member;

a drive for driving both of said rotary propelling devices;

a transmission system coupling said drive to both of said rotary propelling devices; and a programming device controlling said transmission system such that, for selected time intervals, both rotary propelling devices are driven in the same direction, and for other time intervals, said rotary propelling devices are driven in opposite directions;

said transmission system including:

a first shaft coupled with said drive for being driven synchronously with the driving of the first ground-engaging rotary propelling device, the first shaft having thereon a first gear and at a distance spaced apart from the first gear, having thereon a second gear;

a second shaft that is in a parallel orientation with the first shaft, the second shaft having thereon a third gear that is aligned so as to be engaged with the first gear and thereby cause rotation of said third gear in a direction that is opposite to the rotational direction of said first and second gears, and at a distance spaced apart from the third gear, having thereon a fourth gear which is also caused by said third gear to also rotate in said opposite direction;

where the diameter of the first and third gears is larger than the diameter of the second and fourth gears, so that a space is formed between the second and fourth gears; and a third shaft coupled for driving the second ground-engaging rotary propelling device, the third shaft having thereon a fifth gear, the fifth gear being selectably positionable by the programming device to so as to engage one of the second and fourth gears for selected time intervals for causing both rotary propelling devices to be driven in the same direction, and for other time intervals the fifth gear being positionable by the programming device so as to engage an other one of the second and fourth gears for causing the rotary propelling devices to be driven in opposite directions.

2. The robot according to claim 1, wherein said programming device includes a rotary programming member also driven by said drive, and a plurality of presettable elements each individually presettable so as to be displaceable relative to said rotary programming member for controlling said transmission system for a predetermined travel interval of the rotary propelling devices.

3. The robot according to claim 2, wherein said presettable elements control a section of said transmission system connecting said second rotary propelling device to said drive.

4. The robot according to claim 3, wherein said section of said transmission system controlled by said presettable elements includes a reversing mechanism selectively actuatable by said presettable elements.

5. The robot according to claim 4, wherein said reversing mechanism is normally spring-biased to drive the second rotary propelling device in the same direction as the first rotary propelling device, but is actuatable by said presettable elements to actuate the reversing mechanism to drive the second rotary propelling device in the opposite direction as the first rotary propelling device.

6. The robot according to claim 2, wherein said presettable elements are pins individually presettable so as to be displaceable radially of said rotary programming member to either one of a normal position or to a position extended radially of said rotary programming member with respect to said normal position.

7. The robot according to claim 1, wherein during said other time intervals, said one rotary propelling device is driven in one direction and said other rotary propelling device is driven in the opposite direction such that said body member is propelled along a sharply-curved path.

8. The robot according to claim 1, wherein said one side of the body member includes a pair of said first rotary propelling devices on opposite ends of the respective side connected to said drive by a first section of said transmission system, and said opposite side of the body member includes a pair of said second rotary propelling devices at opposite ends of the respective side connected to said drive by a second section of said transmission system; and, wherein said programming device controls said second section of the transmission system.

9. The robot according to claim 1, wherein each of said rotary propelling devices includes a rotary drum and a plurality of externally-ribbed rubber belts in side-by-side relation thereon.

10. The robot according to claim 1, wherein said body member of said programmable steerable robot includes a rotary brush also driven by said drive and engageable with surfaces of the swimming pool for cleaning same.

11. The robot according to claim 10, wherein said drive includes a hydraulic motor connectable to a suction system suctioning out water from the swimming pool for at least one of filtering and disinfecting purposes.

12. A programmable steerable robot for cleaning swimming pools and the like, comprising:

a body member;

a ground-engaging rotary propelling device coupled with the body member;

a drive for providing rotational force to be coupled to said rotary propelling device to cause rotation of said rotary propelling device and translational movement of said body member;

a transmission system for coupling the rotational force provided by said drive to said rotary propelling device; and a programming device controlling said transmission system such that, for selected time intervals, said rotary propelling device is driven in one rotational direction, and for other time intervals, said rotary propelling device is driven in an opposite direction;

said transmission system including:

a first shaft coupled with said drive for being driven in said one rotational direction, the first shaft having thereon a first gear and at a distance spaced apart from the first gear, a second gear, wherein said first and second gears are coupled together such that said first and second gears are caused to rotate in the same direction;

a second shaft that is in a parallel orientation with the first shaft, the second shaft having thereon a third gear that is aligned so as to be engaged with the first gear and thereby cause rotation of said third gear in a direction that is opposite to the rotational direction of said first and second gears, and at a distance spaced apart from the third gear, a fourth gear;

where the diameter of the first and third gears is larger than the diameter of the second and fourth gears, so that a space is formed between the second and fourth gears, and a third shaft coupled for driving the ground-engaging rotary propelling device, the third shaft having thereon a fifth gear, the fifth gear being selectably positionable by the programming device to so as to engage one of said second gear and fourth gear for selected time intervals for causing rotation of the rotary propelling device in one direction, and for other time intervals the fifth gear being positionable by the programming device so as to engage an other one of said second gear and fourth gear for causing rotation of the rotary propelling device in an opposite direction.

13. The robot according to claim 12, wherein the first and second gears are coupled together by said first shaft.

14. The robot according to claim 12, wherein said programming device includes a rotary programming member also driven by said drive, and a plurality of presettable elements each individually presettable so as to be displaceable relative to said rotary programming member for controlling said transmission system for a predetermined travel interval of the rotary propelling devices.

15. The robot according to claim 12, wherein said programming device selectively moves said fifth gear at least partially within said space so as to cause said selective engagement with one of said second and fourth gears.

16. A programmable steerable robot for cleaning swimming pools and the like, comprising:

a body member;

a ground-engaging rotary propelling device coupled with the body member;

a drive for providing rotational force to be coupled to said rotary propelling device to cause rotation of said rotary propelling device and translational movement of said body member;

a transmission system for coupling the rotational force provided by said drive to said rotary propelling device; and a programming device controlling said transmission system such that, for selected time intervals, said rotary propelling device is driven in one rotational direction, and for other time intervals, said rotary propelling device is driven in an opposite direction;

said transmission system including:

a first gearset coupled with said drive for being driven in said one rotational direction, the first gearset having a first gear and at a distance spaced apart from the first gear, a second gear;

a second gearset arranged in a parallel orientation with the first gearset, the second gearset having a third gear that is engaged with the first gear so as to cause rotation of said third gear in a direction that is opposite to the rotational direction of said first and second gears, and at a distance spaced apart from the third gear, a fourth gear;

where the diameter of the first and third gears is larger than the diameter of the second and fourth gears, so that a space is formed between the second and fourth gears, and a shaft coupled for driving the rotary propelling device, the shaft having thereon a fifth gear, the fifth gear being selectably positionable by the programming device to so as to engage one of said second gear and fourth gear for selected time intervals for causing rotation of the rotary propelling device in one direction, and for other time intervals the fifth gear being positionable by the programming device so as to engage another one of said second gear and fourth gear for causing rotation of the rotary propelling device in an opposite direction.

17. The robot according to claim 16, where the first ground-engaging rotary propelling device is positioned at one side of the body member and a second ground-engaging rotary propelling device is positioned at an opposite side of the body member, said first gearset being coupled for being synchronously driven with the first rotary propelling device, and said shaft being coupled for driving the second rotary propelling device.

18. The robot according to claim 16, wherein said first and second gearsets are arranged on a first and second parallel shafts.

19. The robot according to claim 16, wherein the first and second gears are coupled together by a common shaft driven by said drive.

20. The robot according to claim 16, wherein said programming device includes a rotary programming member also driven by said drive, and a plurality of presettable elements each individually presettable so as to be displaceable relative to said rotary programming member for controlling said transmission system for a predetermined travel interval of the rotary propelling devices.

* * * * *